US007850487B1

(12) United States Patent
Wei

(10) Patent No.: US 7,850,487 B1
(45) Date of Patent: Dec. 14, 2010

(54) COAXIAL CABLE CONNECTOR ENHANCING TIGHTNESS ENGAGEMENT WITH A COAXIAL CABLE

(75) Inventor: Kai-Chih Wei, Taipei (TW)

(73) Assignee: Ezconn Corporation, Taipei (TW)

( * ) Notice: Subject to any disclaimer, the term of this patent is extended or adjusted under 35 U.S.C. 154(b) by 0 days.

(21) Appl. No.: 12/659,858

(22) Filed: Mar. 24, 2010

(51) Int. Cl.
*H01R 9/05* (2006.01)

(52) U.S. Cl. ..... 439/578; 439/584

(58) Field of Classification Search ..... 439/578, 439/583, 584, 585
See application file for complete search history.

(56) References Cited

U.S. PATENT DOCUMENTS 5,525,076 A * 6/1996 Down ..... 439/585
6,530,807 B2 * 3/2003 Rodrigues et al. ..... 439/578
6,790,083 B1 * 9/2004 Chen ..... 439/583
6,817,896 B2 * 11/2004 Derenthal ..... 439/578
7,018,235 B1 * 3/2006 Burris et al. ..... 439/584
7,125,283 B1 * 10/2006 Lin ..... 439/578
7,128,603 B2 * 10/2006 Burris et al. ..... 439/578
7,364,462 B2 * 4/2008 Holland ..... 439/584
2005/0032422 A1 * 2/2005 Montena et al. ..... 439/583
2009/0280668 A1 * 11/2009 Rodrigues ..... 439/271

* cited by examiner

*Primary Examiner*—Hae Moon Hyeon
(74) *Attorney, Agent, or Firm*—Bacon & Thomas, PLLC

(57) ABSTRACT

A coaxial cable connector includes a connection head and a sleeve assembly coupled to the connection head. The sleeve assembly includes a tube, a sleeve, and a metal collar. The sleeve assembly receives a coaxial cable to insert therein from a rear end thereof in such a way that an insulator layer of a front end of the coaxial cable is set substantially flush with a front end of the tube and the sleeve assembly is then acted upon by a force applied by a tool to drive the metal collar frontward against the contact section of the sleeve for breaking and separating the retention section of the sleeve from the sleeve to further move frontward along a surface of the buffering section of the sleeve. Due to a constraint imposed by the metal collar, the buffering section is compressed downward to enhance tightness of engagement between the coaxial cable and the connector.

5 Claims, 9 Drawing Sheets

COAXIAL CABLE CONNECTOR ENHANCING TIGHTNESS ENGAGEMENT WITH A COAXIAL CABLE

FIELD OF THE INVENTION

The present invention relates to a structure of coaxial cable connector that enhances tightness engagement with a coaxial cable, and is particularly fit for cables for transmission of signals, such as a coaxial cable or the likes.

BACKGROUND OF THE INVENTION

A conventional cabled television system or a shared antenna television system comprises a cable that is connected to a distributor from which branch cables extend for connection to end users in order to receive and transmit signals of the television system. The main cable comprises a coaxial cable having an end to which a coaxial cable connector is mounted for connection with the distributor.

A conventional coaxial cable connector is shown in FIG. 6 of the attached drawings, which comprises an F type coaxial cable connector comprising a connector body A, which comprises a clamp barrel A1, a hollow plug B coaxially received in the clamp barrel A1, and an O-ring C and a nut D set around the plug B. A coaxial cable 80 has a free end inserted into a terminal end A2 of the connector body A in such a way that an inner insulator layer 82 and a core conductor 81 of the coaxial cable are located inside the plug B, while a shielding layer 83 and an outer jacket 84 of the coaxial cable are located between the plug B and the clamp barrel A1. A tool (not shown) is used to apply a pressure to the clamp barrel A1 so as to force the clamp barrel to securely and tightly engage the outer jacket 84 of the coaxial cable 80.

To couple the conventional connector to a coaxial cable, a tool is needed to clamp the clamp barrel A1 and the coaxial cable together. Care must be exercised in using the tool in order to ensure tightness between the clamp barrel A1 and the coaxial cable 80. Carelessness in using the tool may lead to undesired un-tight engagement between the connector and the cable.

Thus, the present invention aims to provide a structure of coaxial cable connector that allows for formation of excellent tightness of engagement and easy operation in order to overcome the above discussed problems of the conventional coaxial cable connectors.

SUMMARY OF THE INVENTION

An objective of the present invention is to provide a coaxial cable connector, which is composed of simplified components and is easy to operate for providing tight engagement with a coaxial cable.

To realize the above objective, the present invention provides a coaxial cable connector comprising a connection head and a sleeve assembly coupled to the connection head. The sleeve assembly comprises a tube, a sleeve, and a metal collar. The tube is received in the sleeve. An end of the sleeve forms in sequence a retention section, a buffering section, and an accommodation section. The retention section and the buffering section have a connection portion therebetween forming a contact section. The metal collar is fit in the retention section with an end of the metal collar positioned against the contact section. As such, the sleeve assembly receives a coaxial cable to insert therein from a rear end thereof in such a way that an insulator layer of a front end of the coaxial cable is set substantially flush with a front end of the tube and the sleeve assembly is then acted upon by a force applied by a tool to drive the metal collar frontward against the contact section for breaking and separating the retention section from the sleeve to further move frontward along a surface of the buffering section. Due to a constraint imposed by the metal collar, the buffering section is compressed downward to enhance tightness of engagement between the coaxial cable and the connector.

BRIEF DESCRIPTION OF THE DRAWINGS

The present invention will be apparent to those skilled in the art by reading the following description of preferred embodiments thereof with reference to the drawings, in which.

DETAILED DESCRIPTION OF THE PREFERRED EMBODIMENTS

Figure 1:
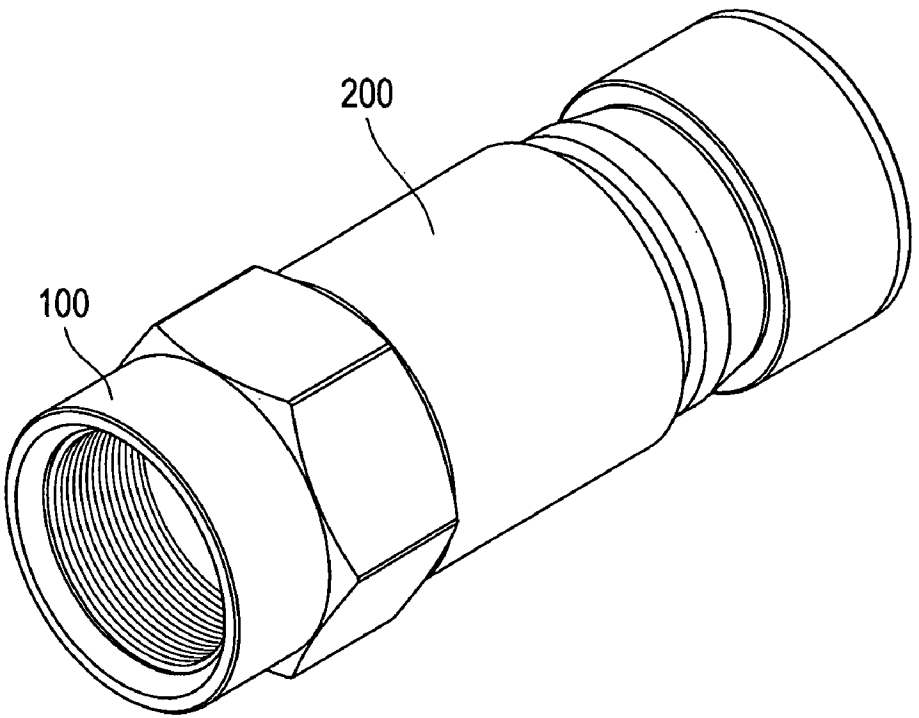
FIG. 1 is a perspective view illustrating a coaxial cable connector constructed in accordance with the present invention.
Figure 2:
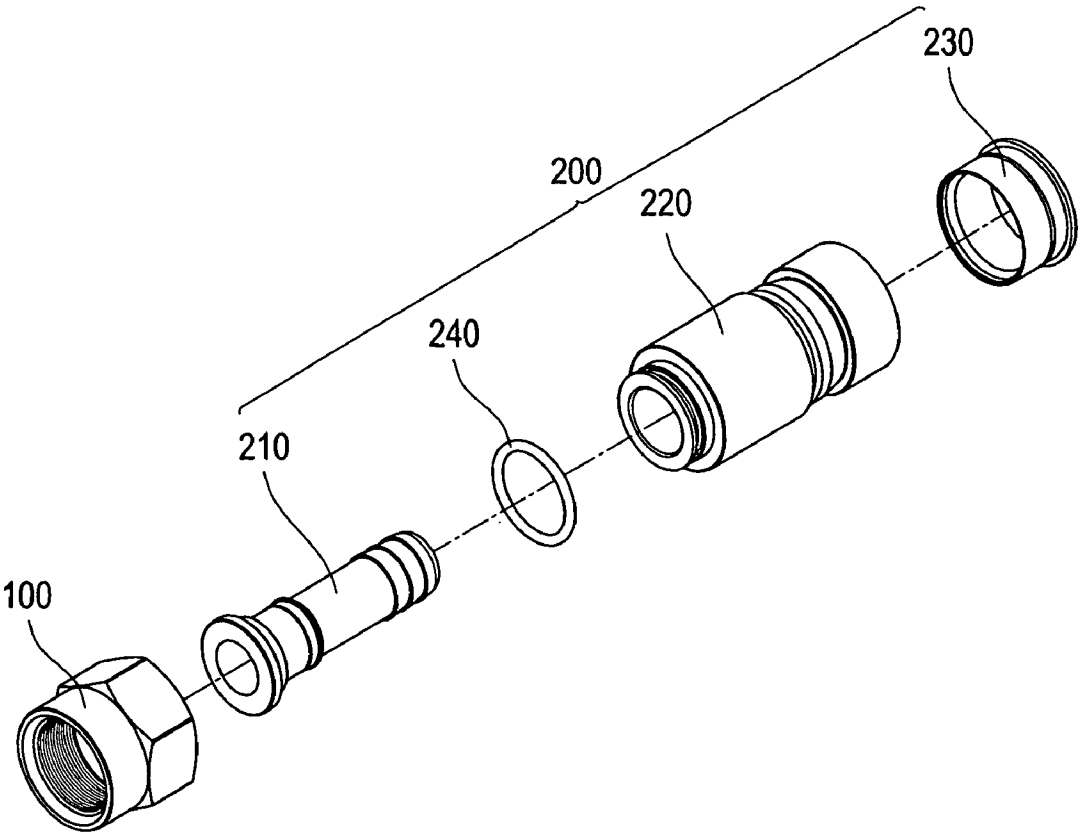
FIG. 2 is an exploded view of the coaxial cable connector in accordance with the present invention.
Figure 3:
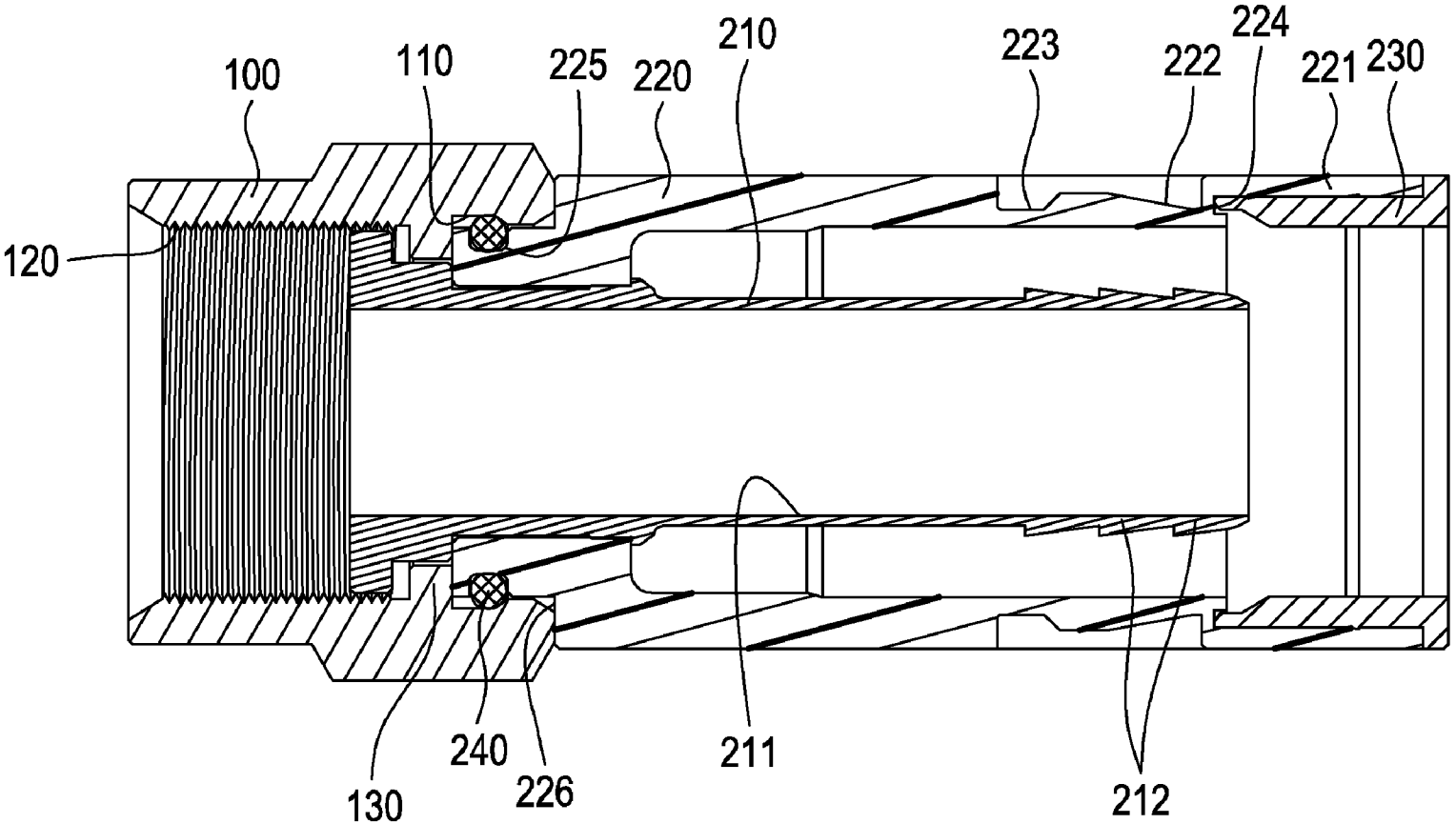
FIG. 3 is a cross-sectional view of the coaxial cable connector in accordance with the present invention.
Figure 5A:
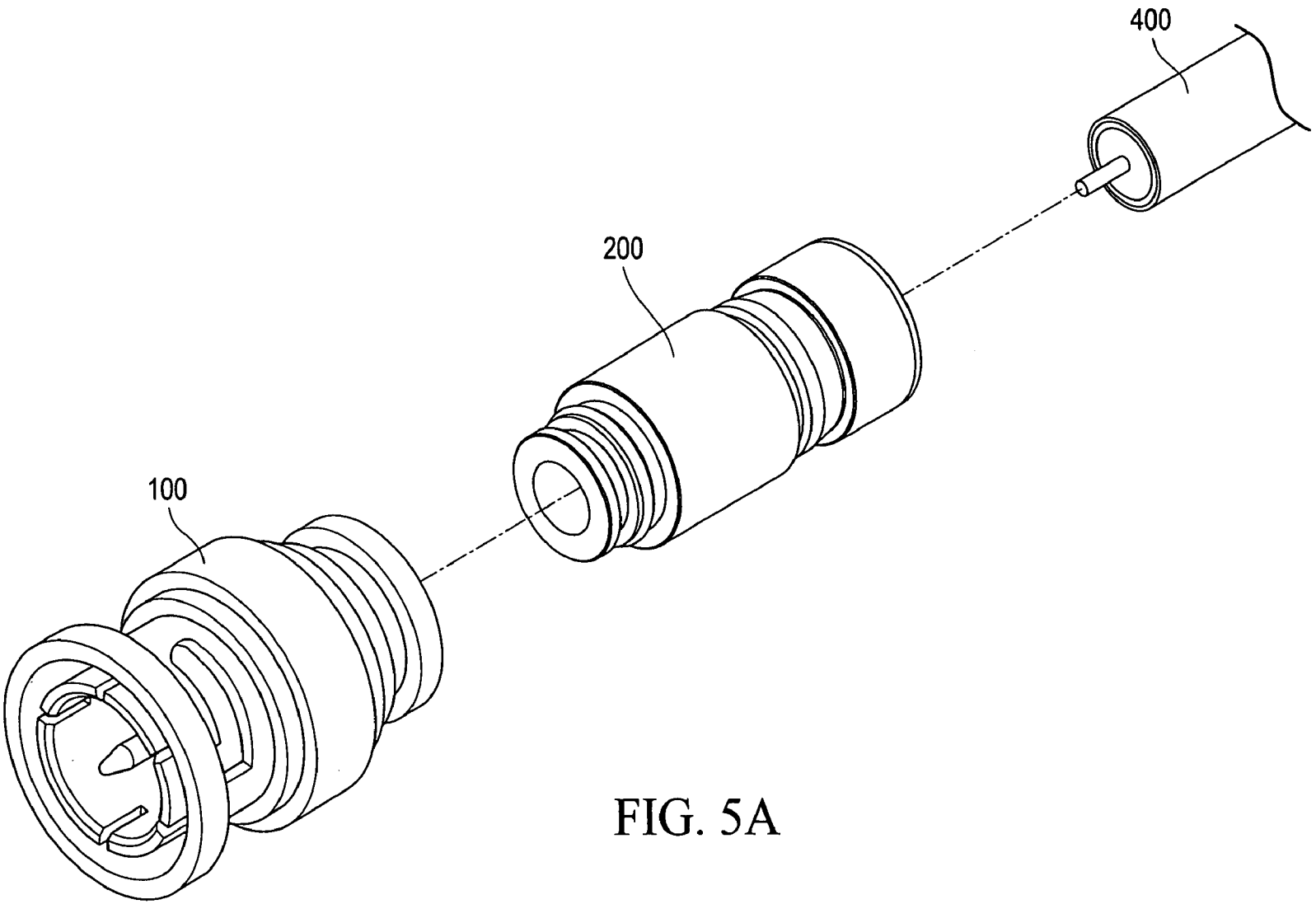
FIGS. 5A-5C are exploded views showing coaxial cable connectors according to the present invention comprising different types of connection heads.
Figure 5B:
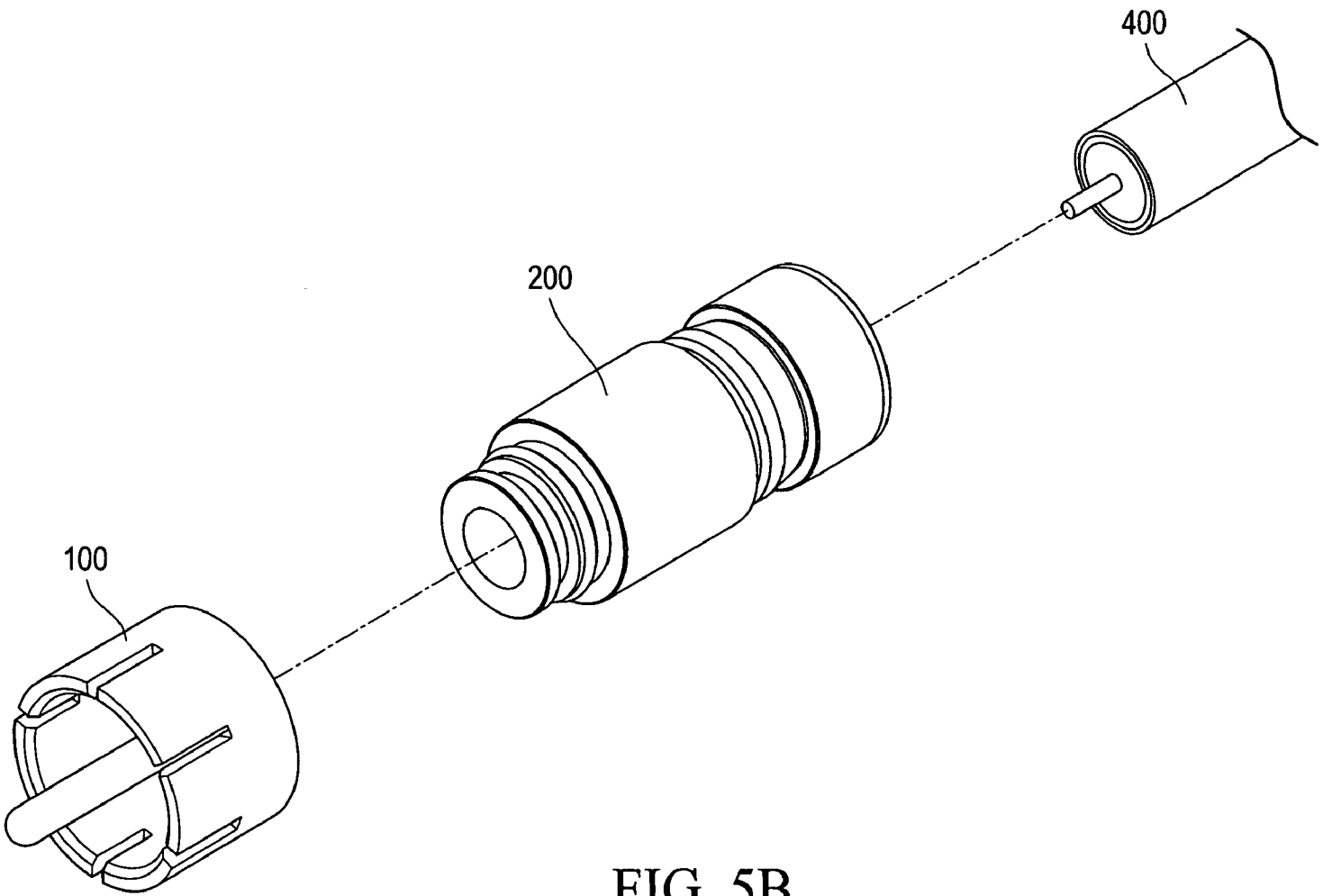
Figure 5C:
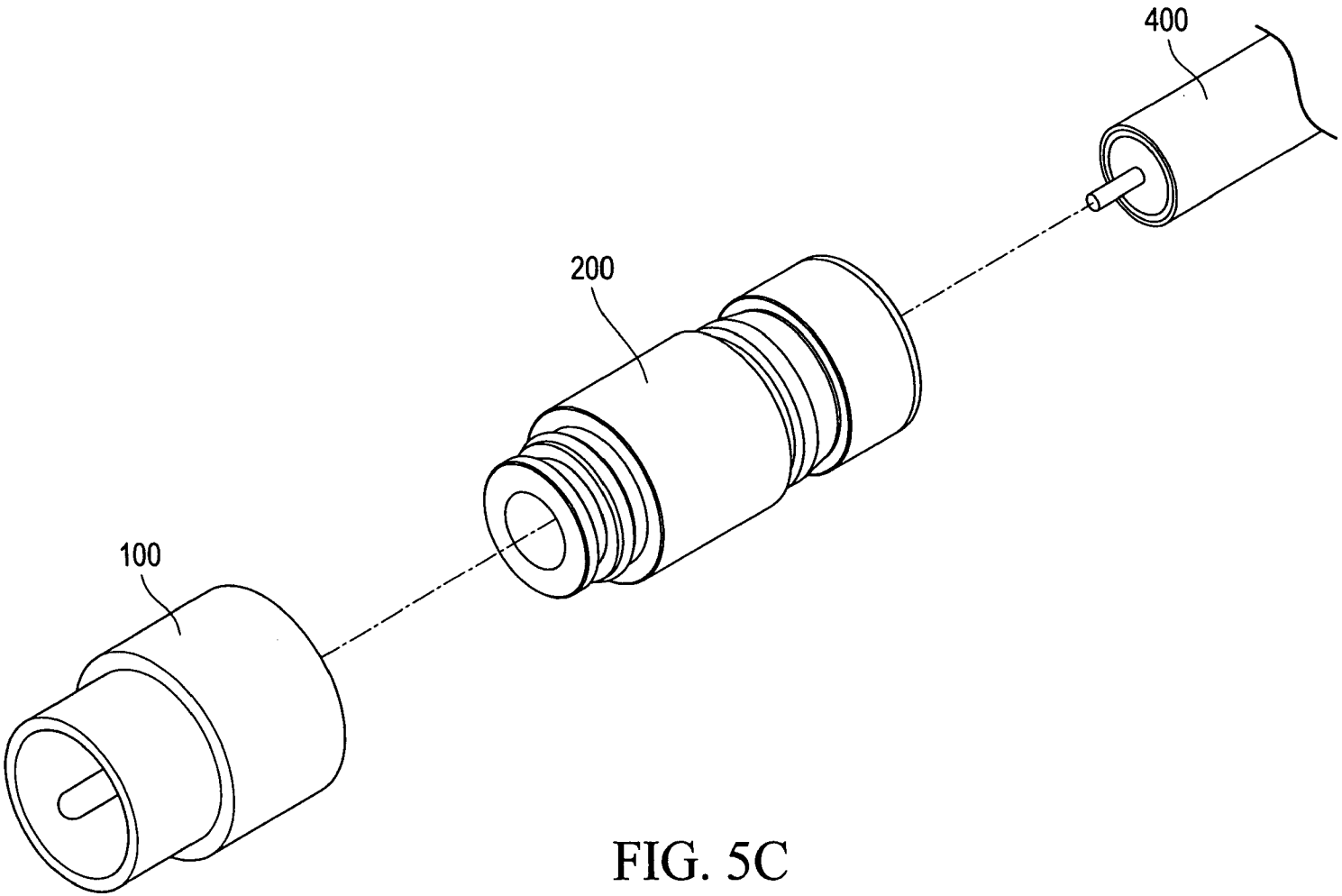
Figure 6:
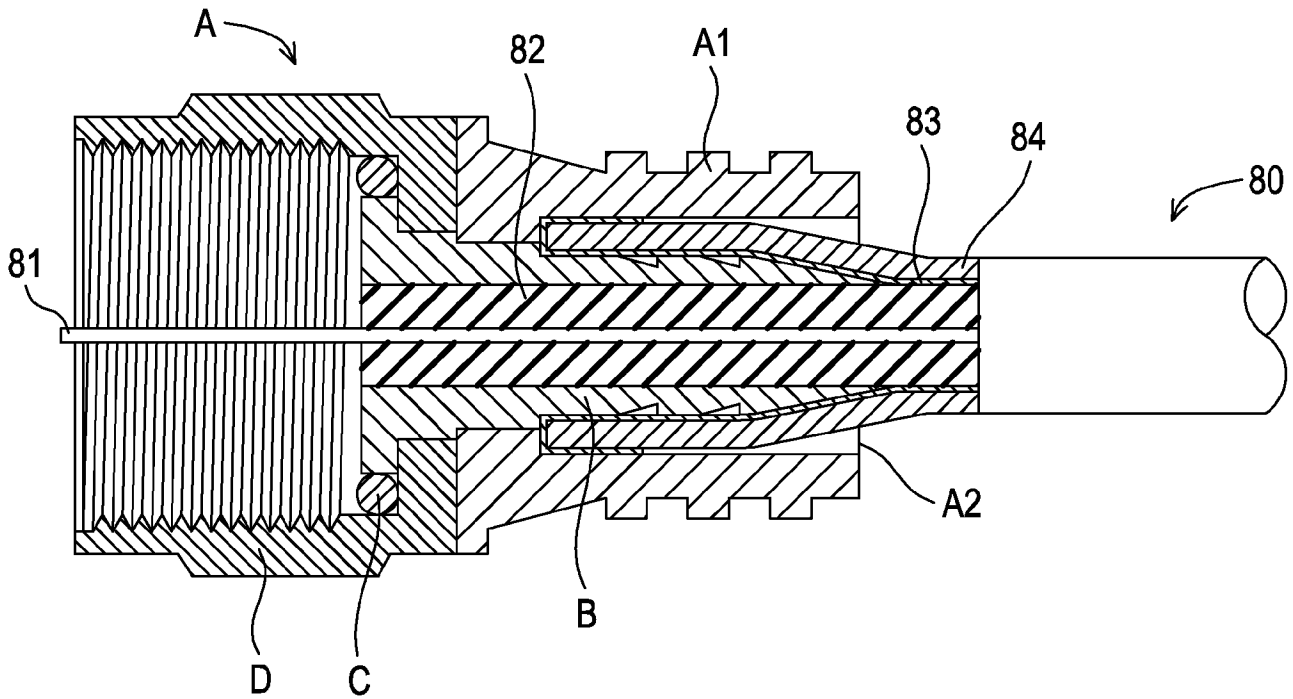
FIG. 6 (PRIOR ART)
FIG. 6 is a cross-sectional view showing a conventional coaxial cable connector coupled to a coaxial cable.

With reference to the drawings and in particular to FIGS. 1-3, a coaxial cable connector constructed in accordance with the present invention generally comprises: a connection head 100 and a sleeve assembly 200. In the embodiment illustrated, the connection head 100 is an F type connection head, which is given for explanation purpose. The connection head 100 has an outer circumference having an axial end portion forming a hexagonal shape. Inside the hexagonal shape, a first groove 110 is formed in an inside surface. Further, the inside surface of the connection head 100 also forms an inner thread 120 and an inner flange 130. It is apparent that the connection head 100 of the coaxial cable connector of the present invention can be alternatively embodied as a Bayonet Neill-Concelman (BNC) type connection head, an Radio Corporation of America (RCA) type connection head, or an International Electrotechnical Commission (IEC) type connection head (respectively shown in FIGS. 5A-5C).

The sleeve assembly 200 comprises a tube 210, a sleeve 220 (which in the instant embodiment is illustratively made of plastics, but is not limited thereto), and a metal collar 230. The tube 210 is received in the sleeve 220 and the tube 210 defines a central bore 211. The tube 210 has an axial rear end forming a plurality of barbs 212. Formed inside an end of the sleeve 200 is a second groove 225, which corresponds to and mate the first groove 110 to form an annular compartment, and a stop 226. An annular seal ring 240 is received and retained in the annular compartment delimited between the first groove 110 and the second groove 225. Formed outside an opposite end of the sleeve 220 are, in sequence, a retention section 221, a buffering section 222, and an accommodation section 223 (which in the instant embodiment comprises a recess). The buffering section 222 comprises a guide slope and the buffering section 222 is formed between the retention section 221 and the accommodation section 223. A contact section 224 is formed at a connection portion between the retention section 221 and the buffering section 222. The metal collar 230 is fit in the sleeve 220 in such a way that an end of the metal collar 230 is positioned against the contact section 224 of the sleeve 220.

The hexagonal shape of the connection head 100 is mounted against the stop 226 of the sleeve 220 and the inner flange 130 of the connection head 100 is set against a front end of the sleeve 220.

Figure 4A:
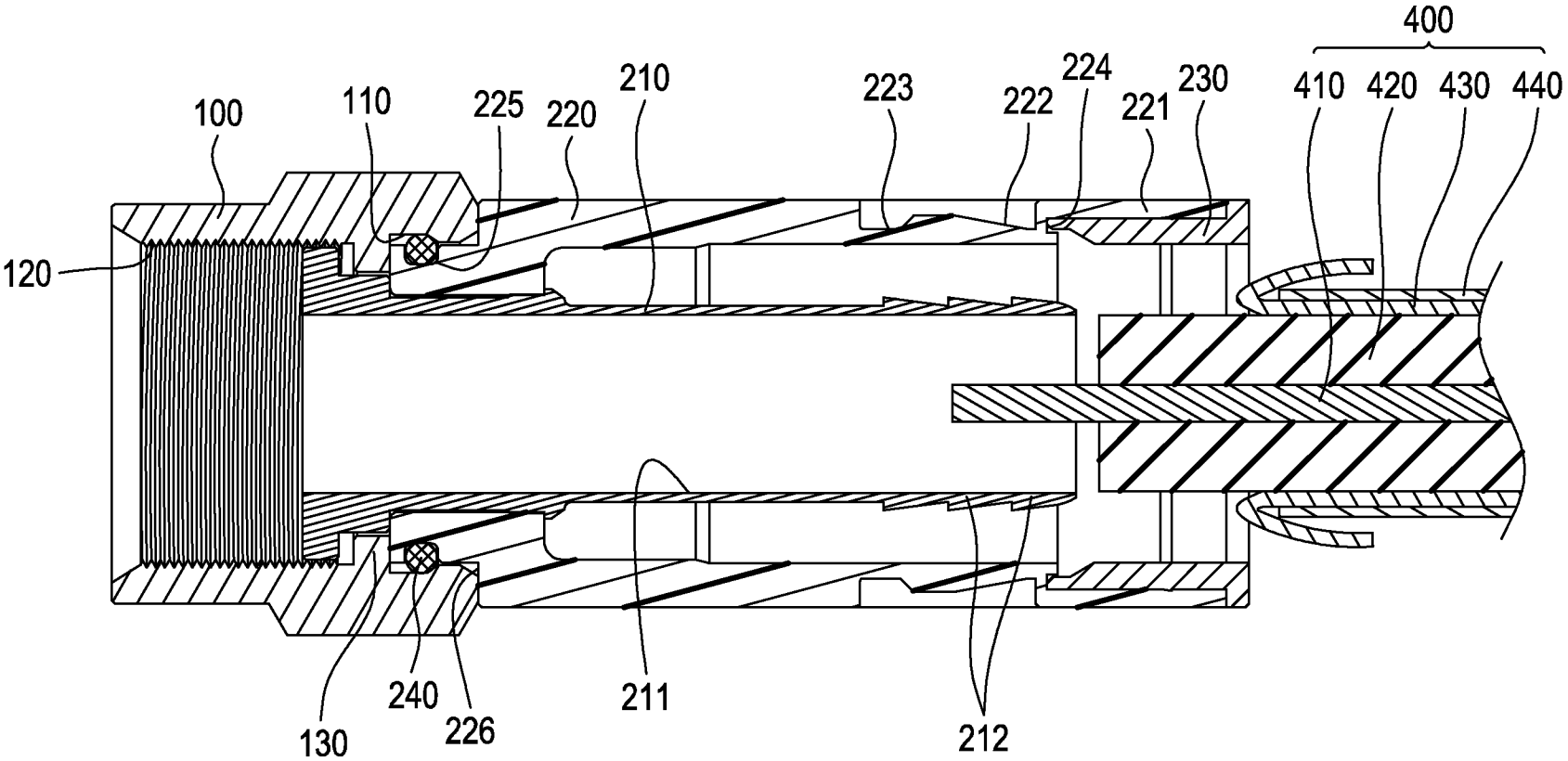
FIGS. 4A and 4B are cross-sectional views respectively showing the coaxial cable connector in accordance with the present invention before and after being coupled with a coaxial cable.
Figure 4B:
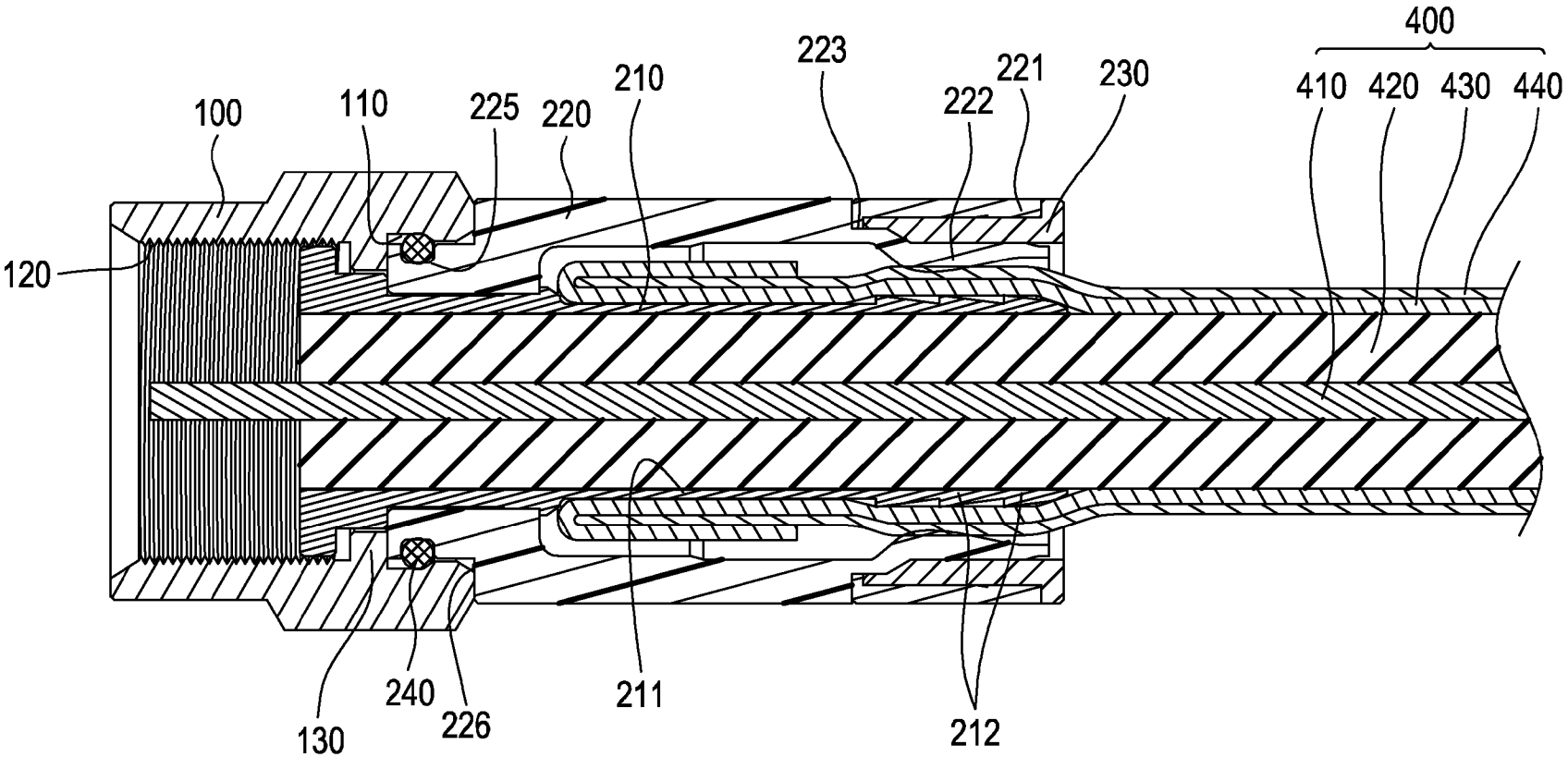

Referring to FIGS. 3-4B, to use, a coaxial cable 400, with a shielding layer 430 peeled off, is inserted from the rear end of the sleeve assembly 200 into the bore 211 of the tube 210 to have a center conductive core 410 and an insulator layer 420 of the coaxial cable 400 received in the bore 211 with insulator layer 420 substantially flush with a front end of the tube 210. The shielding layer 430 and an outer jacket 440 of the coaxial cable 400 are located between the tube 210 and the sleeve 220. A tool is used to apply a force to the sleeve assembly 200 to forcibly drive the metal collar 230 frontward against the contact section 224 (to a shear failure extent thereof), so that the retention section 221 is torn and separated from the sleeve 220 and is subsequently driven along an outer surface of the buffering section 222 in the frontward direction to reach the accommodation section 223 of the sleeve 220, and at the same time, due be the radial constraint imposed by the metal collar 230, the buffering section 222 is forcibly compressed downward to tightly hold the shielding layer 430 and the outer jacket 440 of the coaxial cable 400 against the barbs 212 of the tube 210, by which a secure engagement is formed that enhances tightness of engagement between the coaxial cable 400 and the connector.

To summarize, the coaxial cable connector provided by the present invention offers the following advantages:

(1) The components are simplified and the assembling is easy and convenient, so that when the sleeve assembly is coupled with a coaxial cable, tight and secure engagement can be realized.

(2) The buffering section and the accommodation section of the sleeve have a unique design, which allows for spread of the force induced by deformation when the retention section is being fractured and compressed so as to make the operation easy and effortless.

(3) The contact section of the sleeve has a unique design, which when used in combination of proper application of mechanics, allows for well-controlled and expected fracture of the retention section of the sleeve to further realize easy operation.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A coaxial cable connector, comprising:

a connection head; and a sleeve assembly, which has an end coupled to the connection head, the sleeve assembly comprising a tube, a sleeve, and a metal collar, the tube being received in the sleeve, an end of the sleeve forming in sequence a retention section, a buffering section, and an accommodation section, the retention section and the buffering section having a connection portion therebetween forming a contact section, the metal collar being fit in the retention section with an end of the metal collar positioned against the contact section, wherein the sleeve assembly is adapted to receive a coaxial cable to insert therein from a rear end thereof in such a way that an insulator layer of a front end of the coaxial cable is set substantially flush with a front end of the tube and the sleeve assembly is adapted to be acted upon by a force applied by a tool to drive the metal collar frontward against the contact section for breaking and separating the retention section from the sleeve to further move frontward along a surface of the buffering section, and wherein due to a constraint imposed by the metal collar, the buffering section is compressed downward to thereby enhance tightness of engagement between the coaxial cable and the connector.

2. The coaxial cable connector as claimed in claim 1, wherein the connection head is selected from a group consisting of an F type connection head, a BNC type connection head, an RCA type connection head, and an IEC type connection head.

3. The coaxial cable connector as claimed in claim 1, wherein the connection head forms a first groove and the sleeve has an end forming a second groove to correspond to and mate the second groove for forming a compartment that receives and retains a seal ring therein.

4. The coaxial cable connector as claimed in claim 1, wherein the buffering section comprises a guide slope and the buffering section is formed between the accommodation section and the retention section.

5. The coaxial cable connector as claimed in claim 1, wherein the accommodation section comprises a recess.

* * * * *